US009810228B2

(12) United States Patent
Sun et al.

(10) Patent No.: US 9,810,228 B2
(45) Date of Patent: Nov. 7, 2017

(54) CENTRIFUGAL COMPRESSOR DIFFUSER CONTROL

(75) Inventors: Lin Sun, Tallahassee, FL (US); Jose Alvares, Tallahassee, FL (US); Mogens Rasmussen, Tallahassee, FL (US)

(73) Assignee: DANFOSS A/S (DK)

( * ) Notice: Subject to any disclaimer, the term of this patent is extended or adjusted under 35 U.S.C. 154(b) by 760 days.

(21) Appl. No.: 14/344,407

(22) PCT Filed: Sep. 14, 2011

(86) PCT No.: PCT/US2011/051504

§ 371 (c)(1),
(2), (4) Date: Mar. 12, 2014

(87) PCT Pub. No.: WO2013/039492

PCT Pub. Date: Mar. 21, 2013

(65) Prior Publication Data

US 2015/0010383 A1 Jan. 8, 2015

(51) Int. Cl.

| | |
|---|---|
| ***F04D 17/10*** | (2006.01) |
| ***F04D 27/00*** | (2006.01) |
| ***F04D 27/02*** | (2006.01) |
| ***F04D 29/46*** | (2006.01) |
| ***F25B 1/053*** | (2006.01) |
| ***F04D 29/058*** | (2006.01) |

(52) U.S. Cl.

CPC ..... *F04D 27/002* (2013.01); *F04D 17/10* (2013.01); *F04D 27/001* (2013.01); *F04D 27/0246* (2013.01); *F04D 29/058* (2013.01); *F04D 29/462* (2013.01); *F04D 29/464* (2013.01); *F25B 1/053* (2013.01)

(58) Field of Classification Search

CPC .... F04D 29/462; F04D 29/464; F04D 29/058; F04D 27/001; F04D 27/002; F04D 27/246

USPC ..... 29/462, 464, 58

See application file for complete search history.

(56) References Cited

U.S. PATENT DOCUMENTS 5,576,587 A 11/1996 Takahashi et al.
6,581,399 B2 * 6/2003 Benedict ..... F04D 27/0284 62/228.1

(Continued)

FOREIGN PATENT DOCUMENTS

WO 2010141815 12/2010

OTHER PUBLICATIONS

International Preliminary Report for International Application No. PCT/US2011/051504 dated Mar. 27, 2014.

(Continued)

*Primary Examiner* — Woody Lee, Jr.
(74) *Attorney, Agent, or Firm* — Carlson, Gaskey & Olds, P.C.

(57) ABSTRACT

A centrifugal refrigerant compressor system includes an impeller connected to a shaft. A diffuser is arranged on a downstream side of the impeller and is configured to regulate refrigerant flow exiting the impeller. A magnetic bearing supports the shaft. A sensing element is configured to produce an output relating to a shaft condition. A controller is configured to receive the output and determine an undesired impeller operating condition based upon the shaft condition. The controller is configured to command the diffuser to a desired state in response to the undesired impeller operating condition.

16 Claims, 3 Drawing Sheets

(56) References Cited

U.S. PATENT DOCUMENTS

| | | | | |
|---|---|---|---|---|
| 2007/0224032 | A1* | 9/2007 | Gu | F04D 29/4213 415/58.4 |
| 2010/0005763 | A1* | 1/2010 | Bloom | B01D 45/12 55/315.1 |
| 2011/0048046 | A1 | 3/2011 | Sommer et al. | |
| 2012/0100011 | A1* | 4/2012 | Sommer | F04D 27/02 417/44.1 |

OTHER PUBLICATIONS

International Search Report and Written Opinion dated Feb. 23, 2012.

* cited by examiner

CENTRIFUGAL COMPRESSOR DIFFUSER CONTROL

BACKGROUND

This disclosure relates to a centrifugal refrigerant compressor with a magnetic bearing assembly. More particularly, the disclosure relates to such a refrigerant compressor having a variable geometry diffuser.

Refrigerant compressors are used to circulate refrigerant to a chiller via a refrigerant loop. One type of typical refrigerant compressor operates with a set of variable inlet guide vanes arranged upstream from the impeller for capacity control. The variable inlet guide vanes are actuated during operation of the refrigerant compressor to regulate its capacity during various operating conditions. In one example, the impeller is supported on a rotor shaft by magnetic bearings. Vibrations detected by the magnetic bearing control systems have been used to detect instability in the fluid caused by stall and surge conditions and then regulate the flow through the impeller by controlling the inlet guide vane position.

Variable Geometry Diffusers (VGD) have been suggested for centrifugal refrigerant compressor systems. One typical approach of detecting impeller instability measures the pressure with pressure sensors at either side of the impeller. An undesired pressure differential at a given operating condition indicates impeller instability. The VGD position is then manipulated to regain impeller stability.

SUMMARY

A centrifugal refrigerant compressor system includes an impeller connected to a shaft. A diffuser is arranged on a downstream side of the impeller and is configured to regulate refrigerant flow exiting the impeller. A shaft assembly is supported by a active magnetic bearing system. The magnetic bearing system equipped with position sensors for its feedback control keeps the shaft in the desired position. Under the conditions of stall or surge, the disturbances from the fluid instability will act on the shaft to cause vibration. Sensing elements from magnetic bearing control system are configured to receive the vibration. A controller is configured to use this information to control the diffuser to gain fluid stability. No additional sensing devices like pressure sensors are needed for the diffuser control.

A method of controlling a centrifugal refrigerant compressor includes sensing a shaft condition of a shaft supporting an impeller. Whether an undesired impeller operating condition exists is determined based upon the sensed shaft condition. A diffuser is effectively closed on a downstream side of the impeller in response to an undesired impeller operating condition.

BRIEF DESCRIPTION OF THE DRAWINGS

The disclosure can be further understood by reference to the following detailed description when considered in connection with the accompanying drawings wherein.

DETAILED DESCRIPTION

Figure 1:
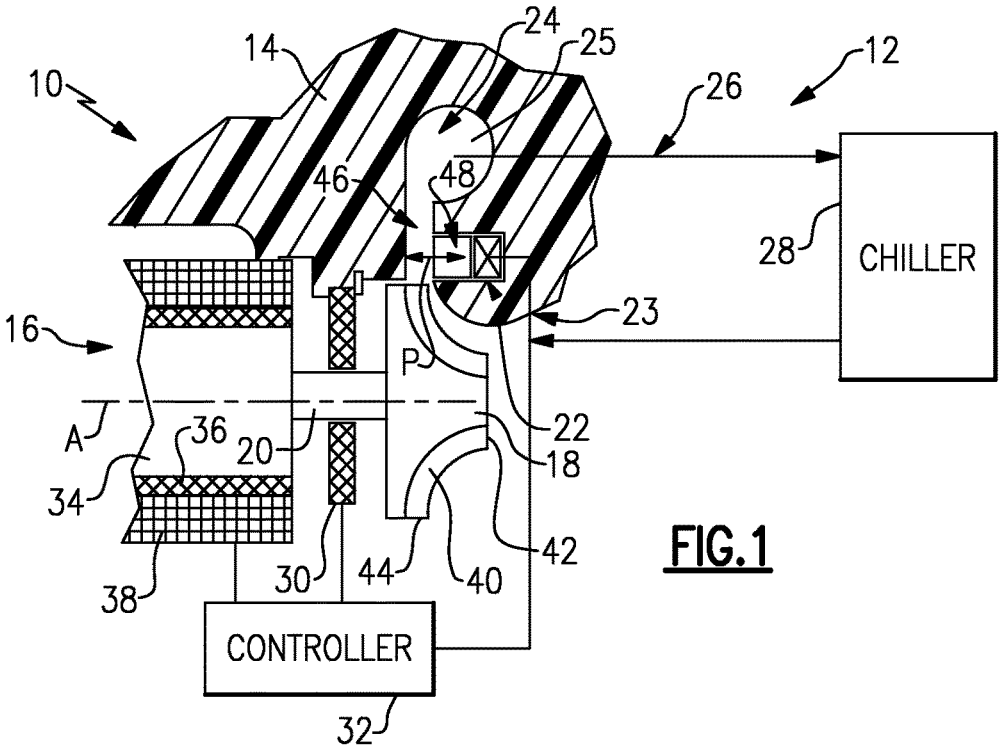
FIG. 1 is a highly schematic view of a refrigerant system having a refrigerant compressor with a magnetic bearing.

Referring to FIG. 1, a refrigeration system 12 includes a refrigerant compressor 10 for circulating a refrigerant. The refrigerant compressor 10 includes a housing 14 within which an electric motor 16 is arranged. The housing 14 is schematically depicted and may comprise one or more pieces. The electric motor 16 rotationally drives an impeller 18 via a shaft 20 about an axis A to compress the refrigerant.

The impeller 18 includes a inlet end 42 and an outlet end 44 in fluid communication with a refrigerant loop 26 that circulates the refrigerant to a load, such as a chiller 28. In the example illustrated in FIG. 1, the compressor contains the impeller 18, which is centrifugal. Although only one impeller is illustrated, multiple impellers can be used. That is, the refrigerant inlet 22 is arranged axially, and the refrigerant outlet 24 is arranged radially. The refrigerant loop 26 includes a condenser, an evaporator, and an expansion device (not shown).

Figure 2:
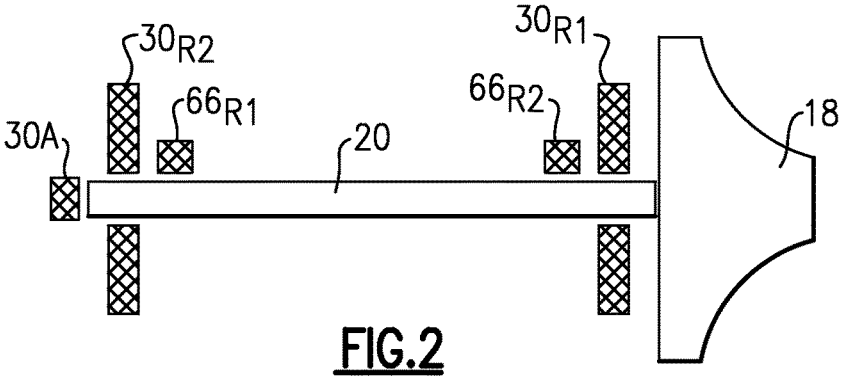
FIG. 2 is a highly schematic view of a shaft-mounted impeller supported by magnetic bearings.

An oil-free bearing arrangement is provided for support of the shaft 20 so that oil-free refrigerant can be used in the refrigerant compressor 10. In the example, the shaft 20 is rotationally supported relative to the housing 14 by a magnetic bearing assembly 30. The magnetic bearing assembly 30 may include radial ($\mathbf{30}_{R1}$, $\mathbf{30}_{R2}$) and/or axial ($\mathbf{30}_{A}$) magnetic bearing elements, for example, as illustrated in FIG. 2. Position sensors 66 (in the example, two radial sensors 66R1 and 66R2) are used to sense the shaft position for control feedback system and vibration monitoring.

Returning to FIG. 1, a controller 32 communicates with the magnetic bearing assembly 30 providing a magnetic bearing command to energize the magnetic bearing assembly 30. The magnetic bearing assembly creates a magnetic field levitating the shaft 20 and controls its characteristics during operation of the refrigerant compressor 10. The controller 32 is depicted schematically, and may include multiple controllers that are located remotely from or near to one another. The controller 32 may include hardware and/or software.

The electric motor 16 includes a rotor 34 supporting multiple magnets 36 about its circumference in one example of permanent magnet motors. A stator 38 is arranged about the rotor 34 to impart rotational drive to the shaft 20 when energized. In one example, the controller 32 communicates with the stator 38 and provides a variable speed command to rotationally drive the impeller 18 at a variable speed depending upon compressor operating conditions. The controller 32 communicates with multiple sensors (not shown) to monitor and maintain the compressor operating conditions.

The impeller 18 includes blades 40 that extend from an inlet end 42 generally radially outwardly along an arcuate path to an outlet end 44. The housing 14 includes an upstream region 23 at the refrigerant inlet 22. A diffuser 48 is provided downstream from the outlet end 44 in a passage 46, upstream from volute 25, to regulate the flow and pressure across the impeller 18 without the need for or use of inlet guide vanes, for example. Although one type of mechanical variable geometry diffusers is illustrated in the example, it should be understood that the diffuser 48 may be any mechanical diffuser, such as an annular ring diffuser, a pipe diffuser or an adjustable variable stator vane diffuser, of the type disclosed in International Application No. PCT/US10/61754 for example. It should also be understood that the diffuser 48 may be a fluid injector, for example, of the type disclosed in International Application No. PCT/US10/55201, used to effectuate refrigerant flow control by effectively changing the fluid flow through the passage 46.

Referring to FIG. 2, an example magnetic bearing configuration is shown for supporting the shaft 20 to which impeller 18 is mounted. In one type of magnetic bearing configuration, a pair of radial bearings $\mathbf{30}_{R1}$, $\mathbf{30}_{R2}$ support either end of the shaft 20. An axial magnetic bearing $\mathbf{30}_{A}$ may be provided adjacent to a thrust feature on the shaft 24 limiting its axial movement. Although the axial bearing $\mathbf{30}_{A}$ is illustrated at a terminal end of the shaft 20, it should be understood that the axial bearing may be located adjacent to a thrust runner and may be integrated with one of the radial bearings, for example. It should also be understood that the shaft 20 may incorporate multiple impellers, for example, an impeller at either end of the shaft 20.

The primary control variable to adjust compressor capacity is the speed of the variable-speed centrifugal compressor. For example, if the chilled water temperature exiting the chiller is lower than its set point value (for example, 4° C. instead of the required set-point value of 5° C.) the controller will reduce the compressor speed to diminish the amount of cooling generated by the chiller which will then bring to chilled water temperature exiting the chiller back to its desired set point value. Under certain chiller operating conditions, further slowing down the speed may drive the compressor to a stall or surge conditions (too low a flow rate for a given pressure ratio) to limit the turn-down capability. In that case, variable geometry diffuser closure as opposed to compressor speed reduction will occur. At incipient surge conditions, the high-frequency rotating stall pressure and flow fluctuations can be seen in bearing orbit signals from position sensors. Using this information, the variable geometry diffuser position can be adjusted to prevent surge or harmful stall.

Figure 3:
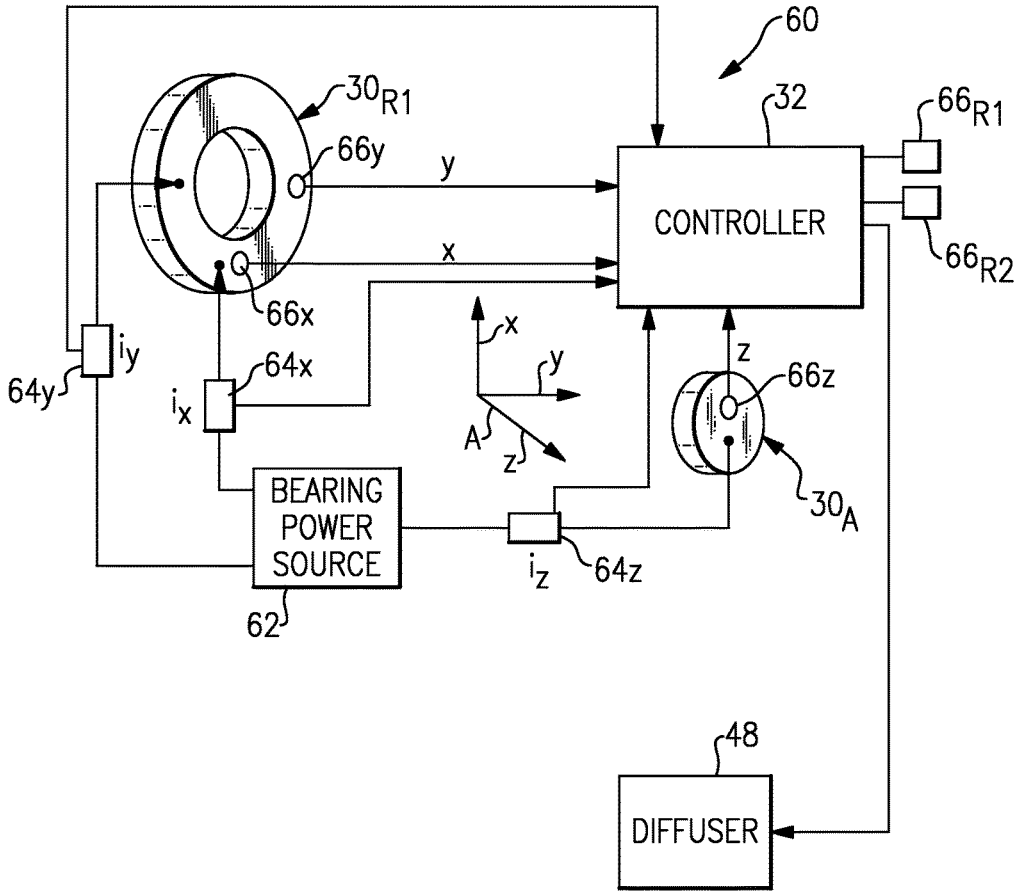
FIG. 3 is a schematic view of an example centrifugal refrigerant compressor control system.

An example compressor control system 60 is illustrated in FIG. 3. In the example, the radial bearing $\mathbf{30}_{R1}$, which is located closest to the impeller 18, is used to detect a shaft condition. The shaft condition, for example, vibration, can be used to determine an undesired impeller operating condition, such as stall or surge. In a stall or surge condition, for example, undesired vibrations are imparted to the magnetic bearings and will be picked up by their sensors that also used for the position control feedback system.

Active magnetic bearing system equipped with position sensing capability integrated with the magnetic bearing. In the example illustrated, the radial bearing $\mathbf{30}_{R1}$ includes position sensors $\mathbf{66}_{X}$, $\mathbf{66}_{Y}$ that respectively detect the position of the shaft 20 relative to the magnetic bearing $\mathbf{30}_{R1}$ in the X and Y directions. The shaft position is communicated to the controller 32, as indicated by the arrows. Similarly, the axial bearing $\mathbf{30}_{A}$ includes a position sensor $\mathbf{66}_{Z}$ that communicates the position of the shaft 20 relative to the axial bearing $\mathbf{30}_{A}$ to the controller 32. Radial bearing position sensors $\mathbf{66}_{R1}$, $\mathbf{66}_{R2}$ also communicate with the controller 32.

A bearing power source 62 supplies power to the bearings $\mathbf{30}_{R1}$, $\mathbf{30}_{A}$. The undesired impeller operating condition may also manifest itself by an additional amount of current drawn from the bearing power source 62 as the magnetic bearings attempt to stabilize the shaft 20 during vibrations induced by stall and/or surge conditions. Accordingly, the electrical circuit providing power to the magnetic bearings may include current sensors $\mathbf{64}_{X}$, $\mathbf{64}_{Y}$, $\mathbf{64}_{Z}$ in communication with the controller 32, which indicate the amount of current drawn by the magnetic bearings respectively in the X, Y and Z directions.

The controller 32 is in communication with the diffuser 48, in particular, an actuator, which manipulates the diffuser 48 to a desired state to regulate the refrigerant flow exiting the impeller 18. In the case of a mechanical diffuser, the actuator may be a linear actuator. In the case of an air injection diffuser, the actuator may be a fluid control valve.

Figure 4:
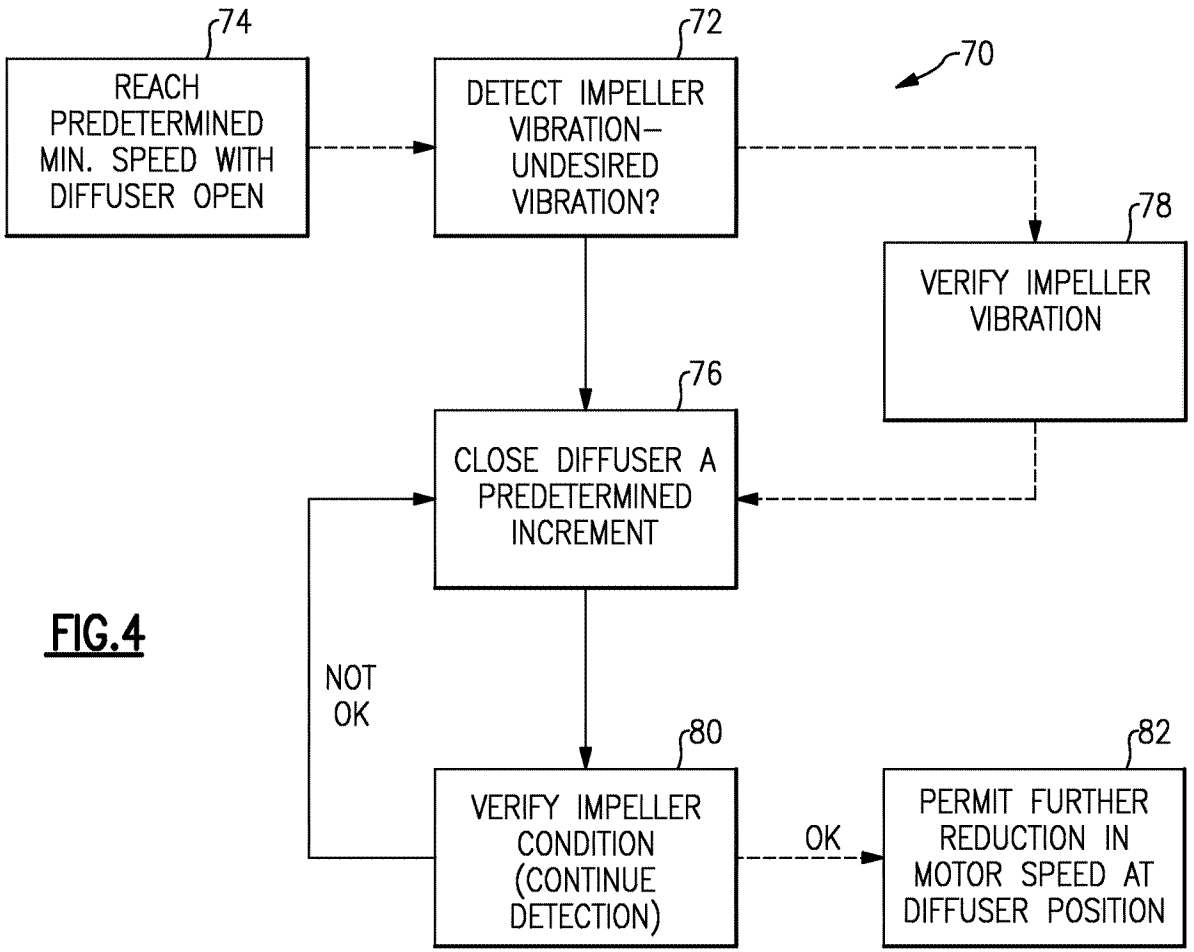
FIG. 4 is an example method of controlling a centrifugal refrigerant compressor.

An example method 70 of controlling the centrifugal refrigerant compressor 10 is illustrated in FIG. 4. The method 70 includes detecting an impeller vibration based upon whether an undesired vibration in the shaft 20 exists, as indicated in block 72. The detection is achieved by at least one of magnetic bearing position sensing or current sensing, as described above. The measured position and/or current is compared to a reference position and/or current, which may be determined empirically for a given compressor. The reference may define a surge or stall line for compressor operating conditions.

For compressor systems in which a variable speed motor is used, the compressor is most susceptible to surge and stall when the motor speed is decreased and the diffuser fully opened. Thus, stall or surge detection may be initiated, for example, once a predetermined minimum shaft speed is reached, as indicated in block 74. In this manner, continuous vibration detection is unnecessary.

If desired, a verification of the impeller vibration may be used as a check on the detection step, as indicated by block 78. For example, if bearing position sensing is used in the detection step, bearing current sensing can be used as a verification as a double check that a undesired shaft condition does indeed exist.

The diffuser is commanded to a desired state, for example, by closing the diffuser a predetermined increment, in response to the detected undesired impeller operating condition, as indicated at block 76. The impeller shaft condition is again checked to verify that the new diffuser state was sufficient to mitigate the undesired impeller operating condition, as indicated at block 80. If the verification was not successful, then the diffuser is closed an additional predetermined increment. If the verification is successful, then a further reduction in motor speed may be performed at the current diffuser state, as indicated at block 82.

Although an example embodiment has been disclosed, a worker of ordinary skill in this art would recognize that certain modifications would come within the scope of the claims. For that reason, the following claims should be studied to determine their true scope and content.

What is claimed is:

1. A centrifugal refrigerant compressor control system comprising:

an impeller connected to a shaft;

a diffuser arranged on a downstream side of the impeller and configured to regulate refrigerant flow exiting the impeller;

a magnetic bearing system supporting the shaft;

a sensing element from the magnetic bearing system configured to produce an output relating to a shaft condition; and a controller configured to receive the output and determine an undesired impeller operating condition based upon the shaft condition only when a predetermined minimum impeller speed is reached with the diffuser in a fully open state, the controller configured to command the diffuser to a desired state in response to the undesired impeller operating condition.

2. The system according to claim 1, wherein the magnetic bearing includes first and second radial bearings and an axial bearing.

3. The system according to claim 2, wherein a radial bearing nearest the impeller provides a sensing element, the sensing element including at least one position sensor.

4. The system according to claim 2, wherein at least one impeller is supported on the shaft and both the first and second radial bearings are used as the sensing elements.

5. The system according to claim 1, wherein the diffuser is provided by a mechanical variable geometry diffuser.

6. The system according to claim 1, wherein the diffuser is provided by a fluid injector.

7. The system according to claim 1, comprising a variable speed motor configured to rotationally drive the shaft.

8. The system according to claim 1, comprising a bearing power source, and the sensing element includes a current sensor configured to measure a current provided from the bearing power source to the magnetic bearing.

9. The system according to claim 1, wherein the undesired impeller operating condition includes at least one of an impeller stall and an impeller surge condition.

10. The system according to claim 1, wherein the shaft condition is shaft vibration.

11. A method of controlling a centrifugal refrigerant compressor comprising:

sensing a shaft condition of a shaft supporting an impeller;

determining whether an undesired impeller operating condition exists based upon the sensed shaft condition, wherein the determining step is initiated only after reaching a predetermined minimum impeller speed with the diffuser in a fully effectively open state; and effectively closing a diffuser on a downstream side of the impeller in response to a detected undesired impeller operating condition.

12. The method according to claim 11, wherein the shaft condition is a shaft vibration, and the undesired impeller operating condition is at least one of an impeller stall condition and an impeller surge condition.

13. The method according to claim 11, wherein the sensing step is performed using at least one of a bearing position sensor and a bearing current sensor.

14. The method according to claim 13, wherein the shaft condition is verified with the other of the at least one of the bearing position sensor and the bearing current sensor.

15. The method according to claim 11, wherein the sensing step and the determining steps are repeated after the effectively closing step.

16. The method according to claim 11, comprising the step of permitting a reduction in motor speed if the undesired impeller operating condition ceases in response to the effectively closing step.

* * * * *